US006189887B1

(12) United States Patent
Dommasch

(10) Patent No.: US 6,189,887 B1
(45) Date of Patent: Feb. 20, 2001

(54) BOARD GAME WITH MULTIPLE REGIONS AND STACKABLE PIECES

(76) Inventor: Daniel A. Dommasch, 3420 SE. Washington St., Portland, OR (US) 97214-3141

( * ) Notice: Under 35 U.S.C. 154(b), the term of this patent shall be extended for 0 days.

(21) Appl. No.: 09/196,657

(22) Filed: Nov. 19, 1998

(51) Int. Cl.[7] ..... A63F 3/02
(52) U.S. Cl. ..... 273/260; 273/290; 273/236
(58) Field of Search ..... 273/236, 242, 273/260, 261, 284, 287, 290, 271

(56) References Cited

U.S. PATENT DOCUMENTS 3,788,644 * 1/1974 Evans .
3,806,125 * 4/1974 Bialek .
4,079,941 * 3/1978 Morales .
4,128,246 * 12/1978 Hicks .
4,131,282 12/1978 Boyer et al. .
4,739,992 4/1988 May .
4,884,819 12/1989 Lambert .
5,318,305 * 6/1994 Lococo .
5,749,583 * 5/1998 Sadounichvili .
5,772,207 * 6/1998 Caseila .
5,839,727 * 11/1998 Stillinger .

* cited by examiner

*Primary Examiner*—Benjamin H. Layno
*Assistant Examiner*—V K Mendiratta

(57) ABSTRACT

A game with a playing area made up of multiple playing regions, with each region made up of multiple playing spaces. The entire playing area can be created on one essentially flat surface. The game can be played by two or more players. Each player has a plurality of stackable playing pieces distinguishable from those of other players. Stacks can be formed from the pieces of one or more players. The player whose piece is on top of a stack controls that entire stack, and thus any underlying pieces belonging to other players are captured. Pieces can be stacked and unstacked during the course of play. If a previously captured piece is uncovered by unstacking, that piece is released and reintroduced into play. Movement of pieces or stacks is allowed both within a region and to other regions. A multi-step unstacking move is included to provide greater reach. The game is won by capturing in stacks all the pieces belonging to opponents. Limits both on the size of stacks and on the number of pieces that can be moved in a step can be imposed.

7 Claims, 6 Drawing Sheets

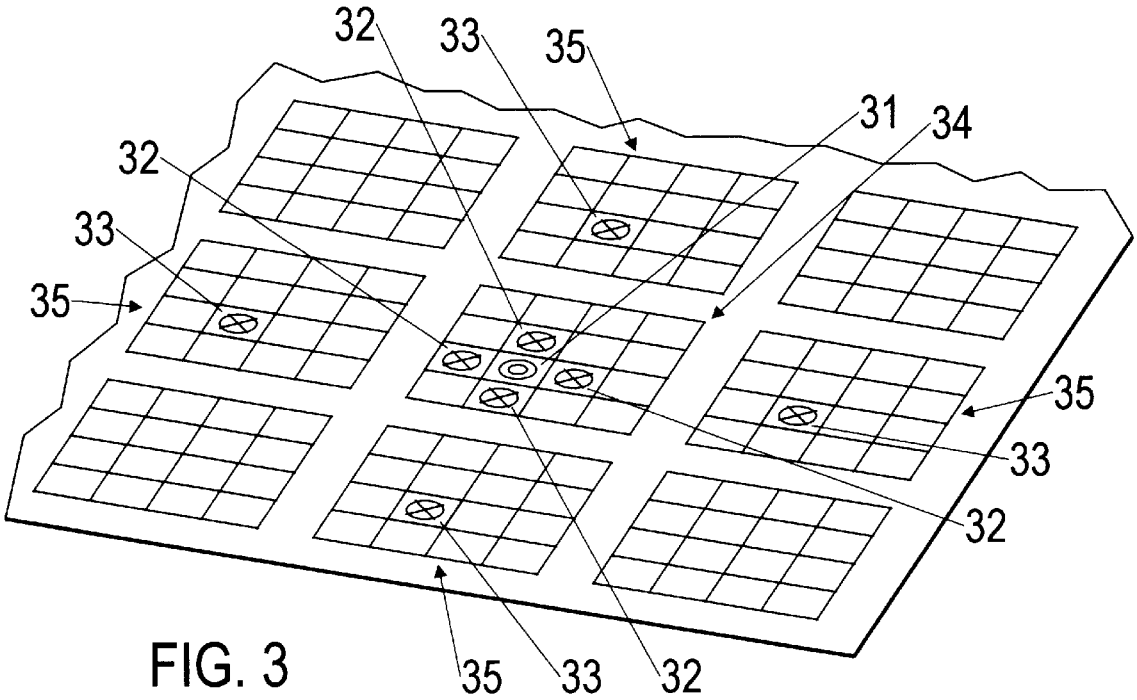
FIG. 3
FIG. 4A
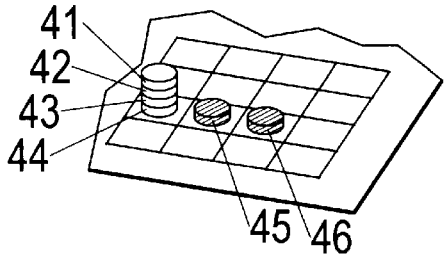
FIG. 4B
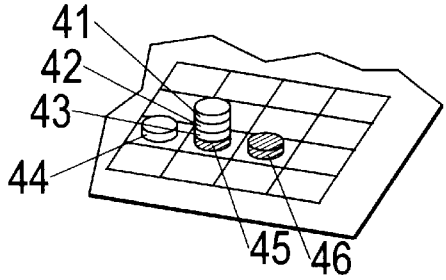
FIG. 4C
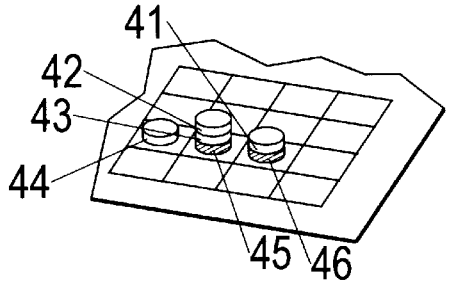

BOARD GAME WITH MULTIPLE REGIONS AND STACKABLE PIECES

BACKGROUND OF THE INVENTION

The present invention pertains to a strategy board game for two or more players, each player utilizing stackable playing pieces distinguishable from opponents' pieces, with the playing area made up of one or more playing regions, and with each playing region made up of one or more playing spaces.

Games that employ multiple playing regions, in which spaces are linked across regions as well as within regions, are not unheard of. However, adding this additional degree of interconnection can pose some problems. The most common forms of multi-region games are 3-D versions of classics like tic-tac-toe and chess. 3-D tic-tac-toe, while very easy to play, is not significantly more stimulating than the original. Variants of 3-D chess, while potentially intriguing to particular geniuses, are simply too convoluted to be appealing to the general population. The fact that multi-region games are not common on toy store shelves indicates the difficulties faced in creating one. What is needed is a multi-region game with moveable pieces for which the rules of movement are simple.

In multi-region games, the range of movement is vast. It would be objectionable if all play centered around only one or a few places, thereby negating any advantage to having multiple playing regions. In addition, a given piece will have many choices of movement at any given time. If pieces always move one space at a time, it becomes difficult to trap all the pieces of an opponent, as there are too many avenues for escape. If pieces are removed from the board in the course of play, this problem becomes even worse, making it tedious and nearly impossible to actually end the game. Of course, if pieces are not removed during play, some other means must be formulated to determine a winner.

Stacking of pieces is not uncommon in board games. Indeed, it can be a great addition to play value if incorporated properly. However, if stacking is just tacked onto an existing non-stacking play pattern, it can be more of a liability than an asset.

Many games rely on an element of chance as a way to introduce variety into an otherwise boring play pattern. An emphasis on luck, however, reduces any incentive to improve one's strategy. There is no skill needed in rolling the dice or spinning a wheel. Making a game interesting without relying on randomness can be challenging, but it is more satisfying to play when the outcome is based solely on the wits of players involved.

It is therefore an object of the present invention to create a novel form of game play through play area arrangement and movement rules that:

a) is easy to learn, but is both entertaining and challenging, even when played on a single or across multiple playing regions,
b) includes the three classic phases of game play, namely, initial opening, mid-game strategy, and end-game tactics,
c) encourages the use of the whole board,
d) incorporates stacking of pieces,
e) provides for the possible release of previously captured pieces,
f) emphasizes strategy and thought instead of randomness and luck,
g) can be realized in an embodiment that is inexpensively manufactured.

These and other objects and advantages of the present invention will become apparent from the accompanying description.

SUMMARY OF THE INVENTION

The present invention uses a playing area made up of multiple playing regions, with each region made up of multiple playing spaces. The entire playing area can be created on one essentially flat surface, and hence can be realized in an embodiment that is inexpensively manufactured.

The game can be played by two or more players. Each player has a plurality of stackable playing pieces distinguishable from those of other players. Stacks can be formed from the pieces of one or more players. The player whose piece is on top of a stack controls that entire stack, and thus any underlying pieces belonging to other players are captured. Pieces can be stacked and unstacked during the course of play. If a previously captured piece is uncovered by unstacking, that piece is released and reintroduced into play. The possibility of releasing previously captured pieces intensifies the strategy of the game.

Rules of the game are easy to learn and remember. Movement of pieces or stacks is allowed both within a region and to other regions. A multi-step unstacking move is included to provide greater reach. This makes it possible to capture any last remaining pieces. The game is won by capturing in stacks all the pieces belonging to opponents.

Limits both on the size of stacks and on the number of pieces that can be moved in a step can be imposed to discourage the piling up of all pieces in one place, and hence, encourage the use of the entire board. Moreover, these limits address the practical problem of physically stacking and moving large numbers of pieces, and may also lead to unstacking and release of previously captured pieces.

The game is played by using thought, strategy, and tactics. No element of chance is necessary. There is enough variation inherent in play that even seasoned players will continually be interested by new scenarios.

DESCRIPTION OF THE DRAWINGS

FIG. 3 shows origination and destination spaces illustrating implicit links.

FIGS. 4A–C show the steps of a particular move.

DESCRIPTION OF THE INVENTION

1. Introduction

In order to better describe the present invention, several embodiments thereof are described below. These descriptions are illustrative in purpose, and in no way limit the scope of the invention.

2. The Preferred Embodiment

Figure 1:
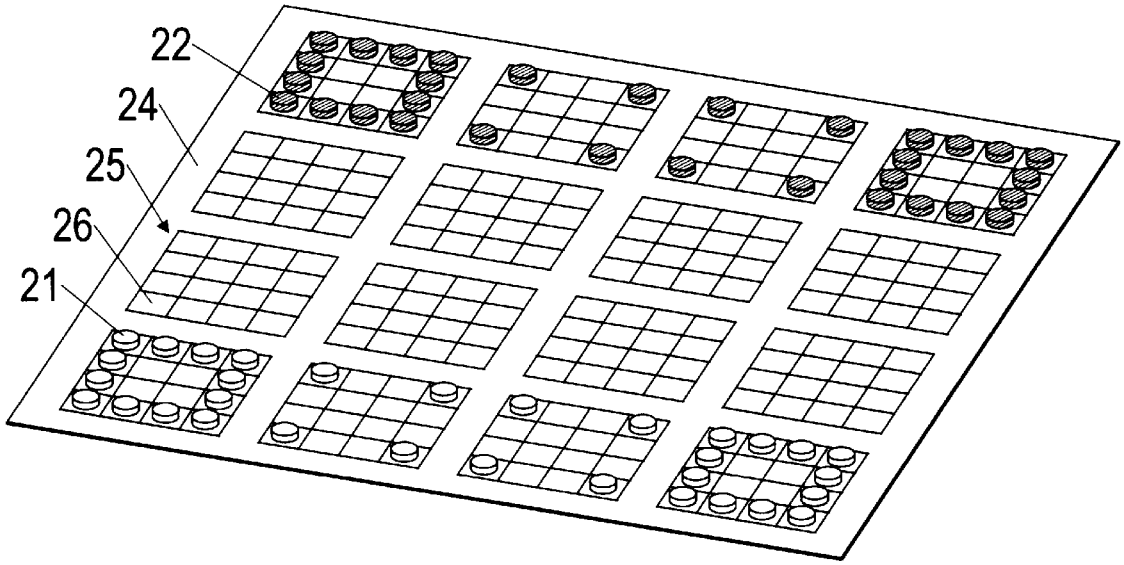
FIG. 1 shows the playing area arrangement and initial piece positions of the preferred embodiment.

The preferred embodiment of the present invention is shown in FIG. 1. In this embodiment there are two players. The playing area 24, is constructed from cardboard or other suitable substance, and has imprinted upon it a pattern similar to that shown in the illustration. The playing area 24 comprises a four-by-four rectangular array of playing regions 25. Each region comprises a four-by-four rectangular array of playing spaces 26. The pieces of player one 21 (light pieces) and the pieces of player two 22 (dark pieces) are initially positioned as shown.

Figure 2:
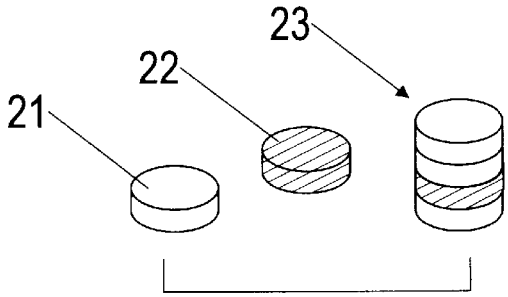
FIG. 2 shows individual pieces and a stack thereof.

Illustrated in FIG. 2 are larger views of the playing pieces 21 and 22, along with a stack of those pieces 23. Playing pieces 21 and 22 are formed from plastic or other suitable material, and are generally discoid in shape. Such pieces are formed with variations in shade or color so that the pieces of player one 21 can be distinguished from the pieces of player two 22. Such pieces are constructed so as to be easily stackable and unstackable, as stacks of pieces 23 are built and unbuilt during the course of play. The player whose piece is on top of a stack is said to control that stack.

Allowed piece movement is constrained by links. A link is an implicit or explicit association of a given space to another space in the playing area. In the preferred embodiment, links are implicit and defined by the geometry of the playing area. A given space has links to the destination spaces immediately adjacent to it in the same region, as well as to the destination spaces that are in the corresponding position as the origination space in the immediately adjacent regions. For example, as shown in FIG. 3, origination space 31 has links to the destination spaces 32 immediately adjacent to it in the same region 34, as well as the destination spaces 33 that are in the same position as the origination space 31 in the immediately adjacent regions 35.

A step is defined as transferring one or more pieces in a stack from an origination space to a destination space, with the requirement that the origination space have a link to the destination space. This is illustrated in FIG. 4A and FIG. 4B, where player one transfers three pieces 41, 42, and 43, capturing opponent's piece 45. A move is defined as one or more steps. The origination space of the first step may be any space that contains a stack that the given player controls, i.e., whose top piece belongs to the given player. The destination space of a step becomes the origination space of the following step. Any step other than the first must transfer fewer pieces than the previous step. Referring to FIG. 4C, we see another step taken after the first, where player one transfers one piece 41, capturing an additional opponent's piece 46, and completing the move.

Figure 5A:
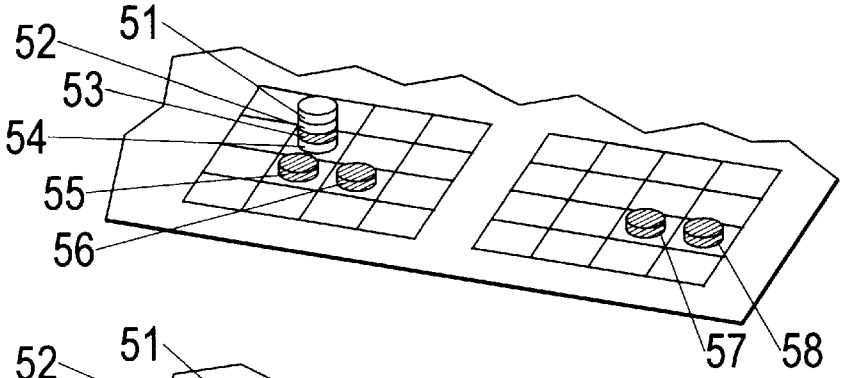
FIGS. 5A–E show the steps of another particular move.
Figure 5B:
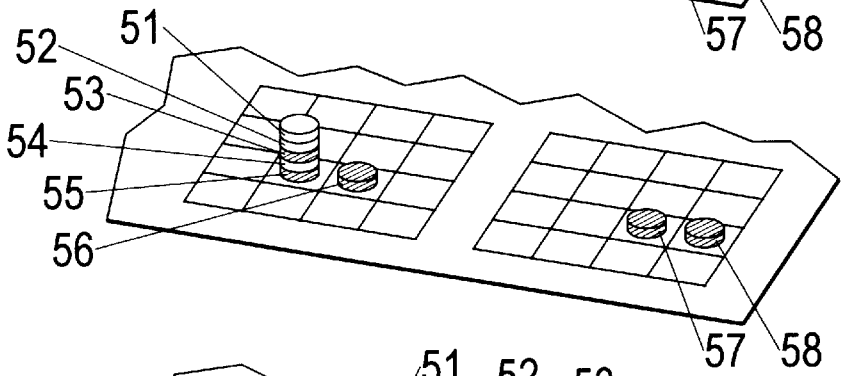
Figure 5C:
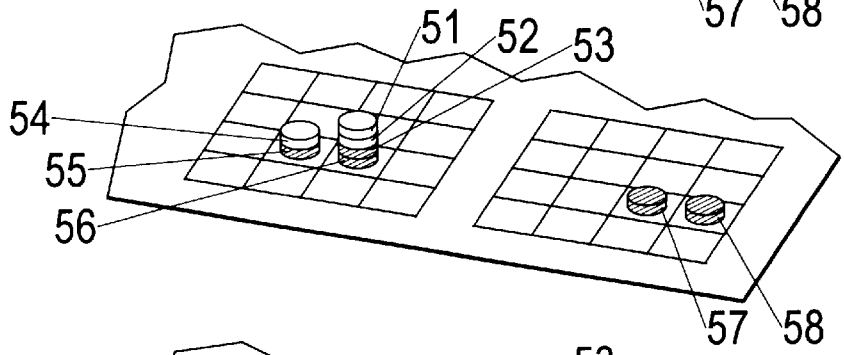
Figure 5D:
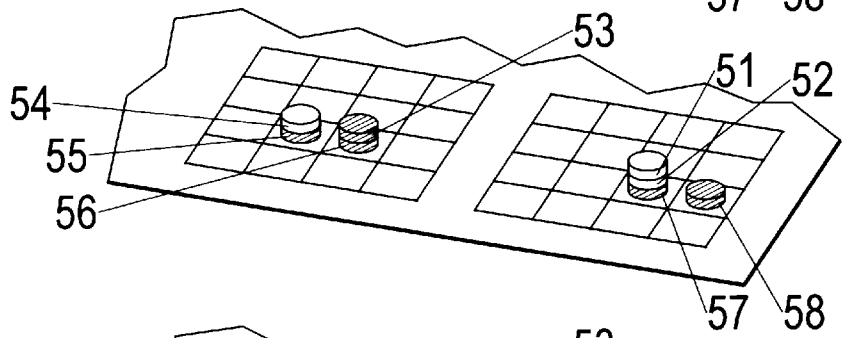
Figure 5E:
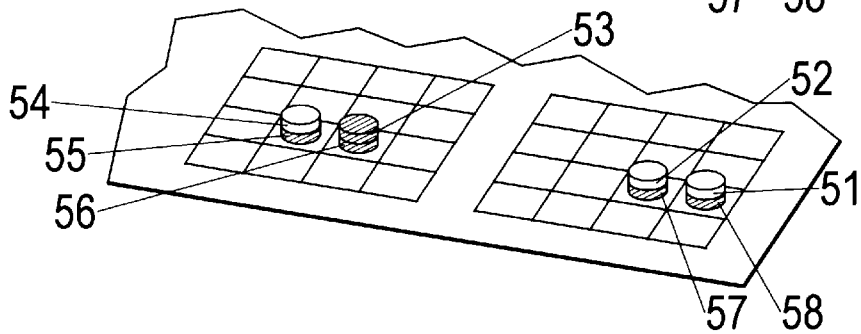

Another move is illustrated in FIGS. 5A–E, showing the initial position and the four subsequent steps taken by player one. FIG. 5A shows the positions at the beginning of the move. On the first step, seen in FIG. 5B, player one moves pieces 51, 52, 53, and 54, to capture the opponent's piece 55. Note that piece 53 in the stack actually belongs to the player two, having been captured in some previous move. On the second step, seen in FIG. 5C, player one moves pieces 51, 52, and 53, capturing an opponent's pieces 56. On the third step, seen in FIG. 5D, player one moves pieces 51 and 52, capturing an opponent's pieces 57. However, this step has the side effect of releasing opponent's pieces 53 and 56. On the fourth step, seen in FIG. 5E, player one moves piece 51 to capture opponent's piece 58. This completes the move by player one. At this point it would be player two's turn, who could then move release pieces 53 and 56.

Figure 6A:
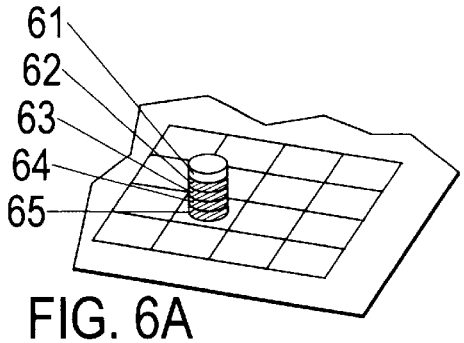
FIGS. 6A,B show the effect of limiting the number of pieces that can be moved FIGS. 7A,B show the effect of limiting the size of stacks.
Figure 7A:
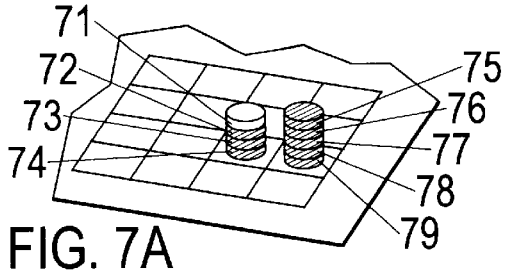
Figure 6B:
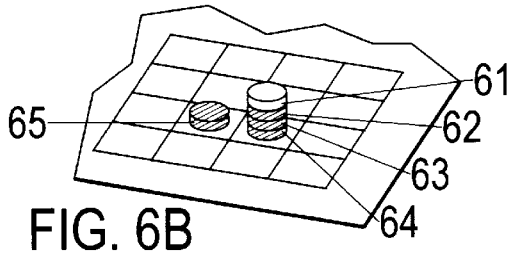
Figure 7B:
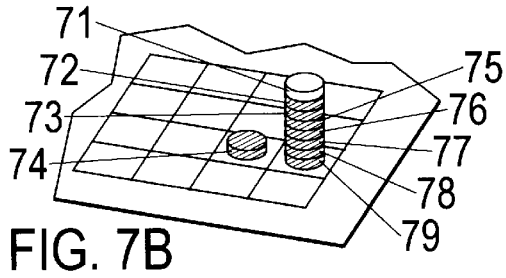

In the preferred embodiment, the number of pieces that can be transferred in a step is limited to four. This is illustrated in FIGS. 6A and 6B, where player one can only move four pieces 61, 62, 63, and 64, thereby releasing opponent's piece 65. In addition, the size of stacks is limited to eight. This is shown in FIGS. 7A and 7B, where player one attempts to control a large stack of five opponent's pieces 75, 76, 77, 78, and 79, but can only transfer three pieces 71, 72, and 73, resulting in the release of opponent's piece 74.

To begin the game, the pieces of both players are laid out in their initial positions. Player one makes the first move, followed by player two. This continues until one of the players is unable to make a move, i.e., does not control any stacks, whereby the other player is declared the winner.

3. Several Alternative Embodiments

Figure 8:
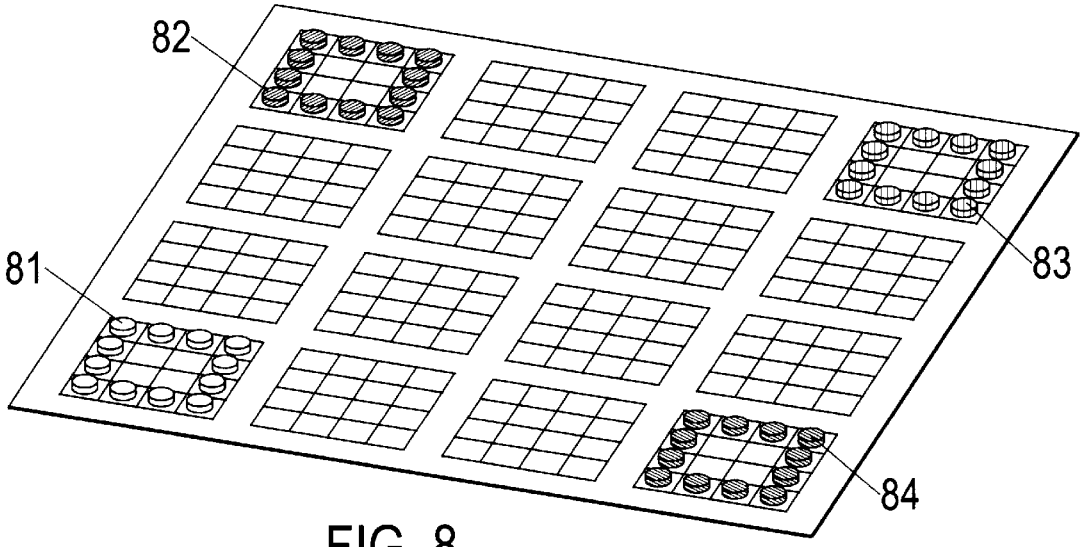
FIG. 8 shows the initial piece positions of an alternative embodiment.

The game can be played by more than two players. Shown in FIG. 8 is the same game board as the preferred embodiment, but with initial piece positions for four players, with the pieces of player one 81, pieces of player two 82, pieces of player three 83, and the pieces of player four 84. Play begins with player one, and then passes to each player in turn. When a player is unable to move, that player must pass without moving. (However, future moves by opponents may release pieces that can be moved on subsequent turns.) When only one player is able to move, that player is declared the winner. (Another variation would be that if a player is unable to move, that player must leave the game instead of passing.)

Figure 9A:
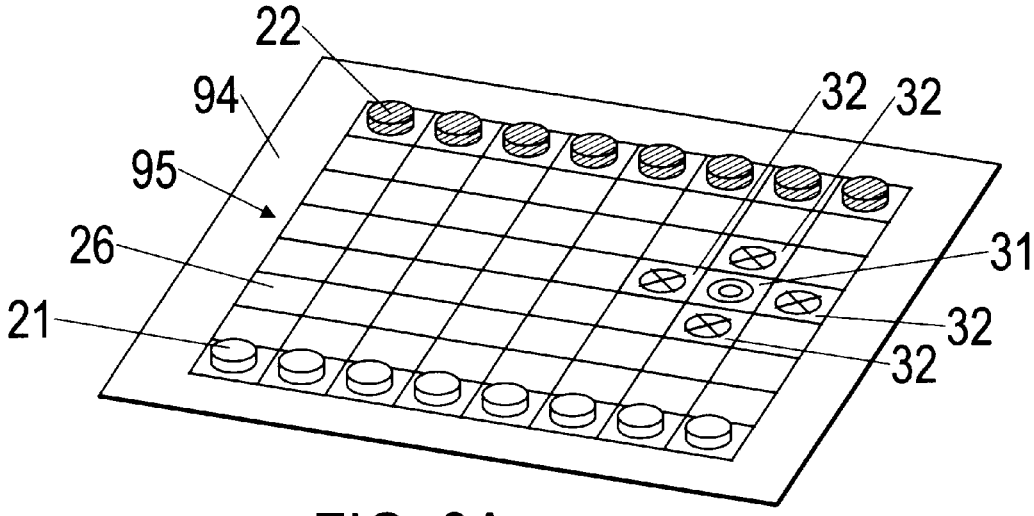
FIGS. 9A,B show the playing area arrangement, initial piece positions, and links, of additional alternative embodiments.

Other arrangements of the playing area are possible. Shown in FIG. 9A is an area 94 with only one region 95. This region is larger, however, comprising an eight-by-eight rectangular array of spaces 26. Pieces of player one 21 and pieces of player two 22 are shown in their initial positions. In addition, with only one region, spaces have fewer links. For example, a given origination space 31 has links only to destination spaces 32.

Figure 9B:
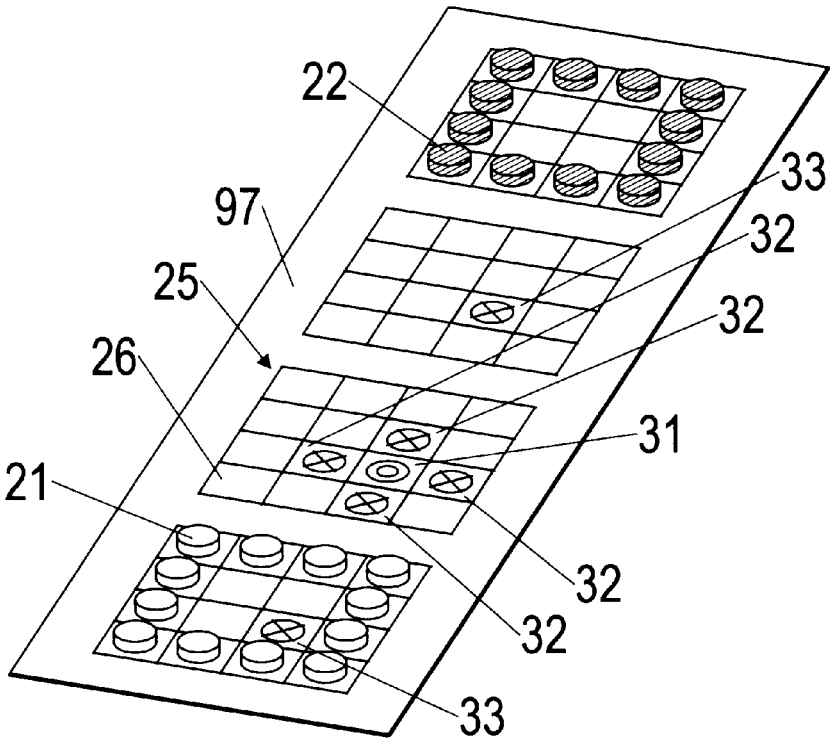

Shown in FIG. 9B is an area 97 with four regions 25. Each region is similar to those in the preferred embodiment, comprising a four by four rectangular array of spaces 26. Pieces of player one 21 and pieces of player two 22 are shown in their initial positions. For an example of links in this embodiment, a given origination space 31 has links to destinations spaces 32 and 33.

Figure 10A:
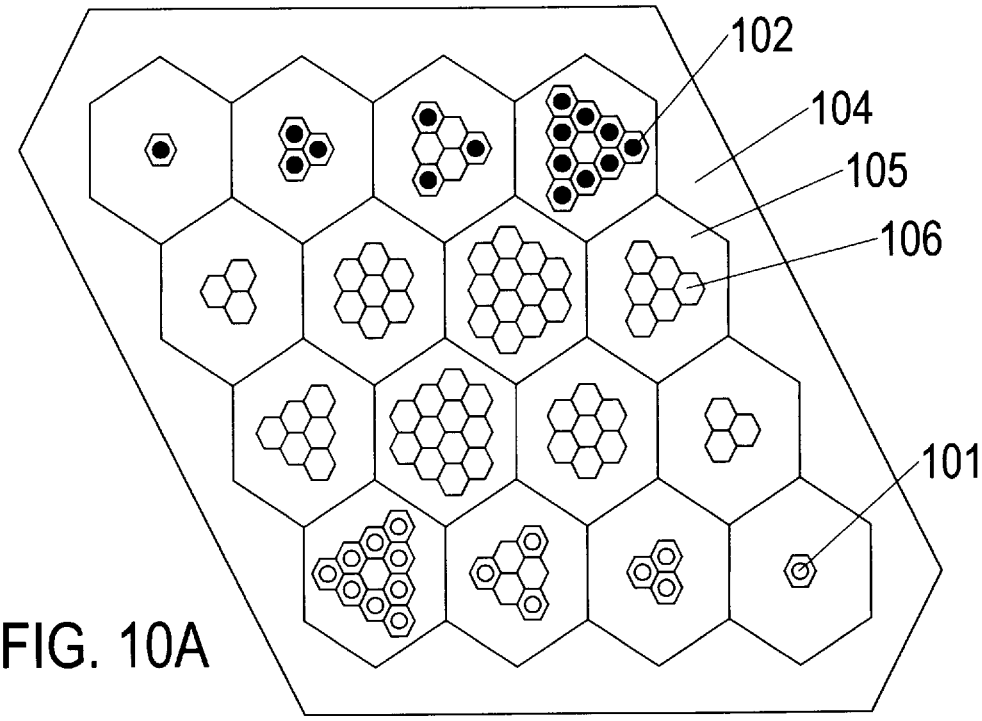
FIGS. 10A,B show the playing area arrangement, initial piece positions, and links, of yet another alternative embodiment.

A significantly different embodiment is illustrated in FIG. 10A. In this playing area 104, both the regions 105 and the spaces 106 within them are arranged in hexagonal arrays. In addition, the regions do not all have the same number spaces within them. Initial positions of the pieces of player one 101 and the pieces of player two 102 are shown.

Figure 10B:
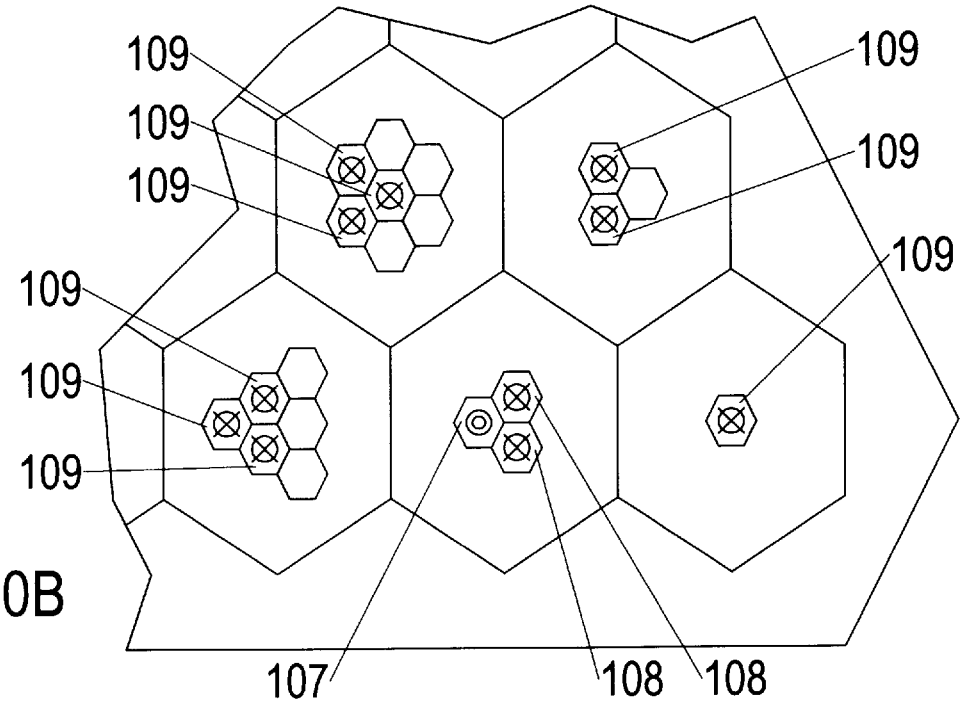

The links between spaces are somewhat more involved. As shown in FIG. 10B, a given origination space 107 has links to all the destination spaces 108 immediately adjacent to it within the same region. In addition, it has links to destination spaces 109 in immediately adjacent regions, where, if such regions were laid on the origination region, the destination spaces would partially overlap the origination space.

4. Other Embodiments

There are many materials suitable for constructing the playing area and pieces. The playing area could contain indentations to securely hold the pieces on the spaces. The pieces themselves could have indentations to facilitate stacking. Alternatively, playing area and pieces could even be constructed from patterns of light and color on a computer display.

Other arrangements of the playing area are possible. Regions and spaces could be placed in a circular or even irregular fashion. Links between spaces could be made explicit with lines or arrows drawn on the playing area, and need not be reciprocal.

While many embodiments and specificities have been illustrated in the description of the present invention, these should not be construed as to limit its scope. Many other variations, modifications, and equivalents are possible without departing from the spirit of the invention. Accordingly, the scope of the present invention should be determined only by the appended claims and their legal equivalents.

What is claimed is:

1. A method of playing a game for at least two players comprising a) providing i) a plurality of playing pieces, each of said pieces having a means for being associated with one of said players, ii) a playing area, said area comprising at least one playing region, each of said regions comprising at least one playing space, iii) each of said spaces having some number of links, each of said links being a means for associating said space to other spaces in the playing area, iv) each of said spaces having a means for holding a stack, said stack comprising a number of said pieces, said number being at least one, v) each of said stacks having a top piece, said top piece being the only piece if the stack comprises one piece, b) enabling each of said players to make moves in turn, each of said moves by said player comprising at least one step i) the first of said steps comprising (a) selecting an origination space from one of the spaces holding a stack in which the top piece of the stack on said origination space is associated with said player, (b) selecting a destination space from one of the spaces to which the origination space has a link, (c) selecting a number of pieces to transfer, said number being at least one, (d) transferring said number of pieces from the top of the stack on the origination space to the destination space, placing said pieces on top of any stack already on the destination space, ii) each of the remainder of said steps comprising (a) defining an origination space as the destination space of the last step, (b) selecting a destination space from one of the spaces to which the origination space has a link, (c) selecting a number of pieces to transfer, said number being at least one and less than the number of pieces transferred on the last step, (d) transferring said number of pieces from the top of the stack on the origination space to the destination space, placing said pieces on top of any stack already on the destination space, c) declaring a winner, said winner being the final player for which it is possible to make a move.

2. The method of claim 1 wherein said regions are arranged in a geometrical pattern within said area, and said spaces are arranged in a geometrical pattern within said regions.

3. The method of claim 2 wherein said pattern of regions is a rectangular array, said pattern of spaces is a rectangular array, and said spaces are arranged in an identical fashion in all said regions.

4. The method of claim 3 wherein said links are to adjacent spaces in the same region and to positionally corresponding spaces on adjacent regions.

5. The method of claim 4 wherein said rectangular array of regions consists of four rows and four columns, and said rectangular arrays of spaces consist of four rows and four columns.

6. The method of claim 5 wherein the number of pieces to transfer in a step is at most a predetermined limit, and the size of any stack is at most a predetermined limit.

7. The method of claim 6 wherein the predetermined limit of the number of pieces to transfer in a step is four, and the predetermined limit of the size of any stack is eight.

* * * * *